US007446739B2

(12) United States Patent
Nakanishi et al.

(10) Patent No.: US 7,446,739 B2
(45) **Date of Patent: *Nov. 4, 2008**

(54) ELECTRO-OPTICAL DEVICE, METHOD TO DRIVE THE SAME, AND ELECTRONIC APPARATUS

(75) Inventors: Hayato Nakanishi, Toyama-ken (JP); Tokuro Ozawa, Suwa (JP); Takashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 758 days.

This patent is subject to a terminal disclaimer.

(21) Appl. No.: 10/828,438

(22) Filed: Apr. 21, 2004

(65) Prior Publication Data

US 2005/0001794 A1 Jan. 6, 2005

(30) Foreign Application Priority Data

Apr. 25, 2003 (JP) ..... 2003-121841

(51) Int. Cl.
*G09G 3/30* (2006.01)

(52) U.S. Cl. ..... 345/76; 345/81; 345/82; 345/84; 345/89; 345/207; 345/211; 345/690

(58) Field of Classification Search ..... 345/76–104, 345/204–215, 690
See application file for complete search history.

(56) References Cited

U.S. PATENT DOCUMENTS

| | | | | |
|---|---|---|---|---|
| 7,050,024 | B2 * | 5/2006 | LeChevalier | 345/84 |
| 7,145,530 | B2 * | 12/2006 | Miyazawa | 345/76 |
| 7,158,103 | B2 * | 1/2007 | Nakanishi | 345/76 |
| 2004/0100427 | A1 * | 5/2004 | Miyazawa | 345/76 |

FOREIGN PATENT DOCUMENTS

| | | |
|---|---|---|
| JP | A 2002-175045 | 6/2002 |
| JP | A 2003-022049 | 1/2003 |
| JP | A 2003-022050 | 1/2003 |

* cited by examiner

*Primary Examiner*—Vijay Shankar
(74) *Attorney, Agent, or Firm*—Oliff & Berridge, PLC

(57) ABSTRACT

To suppress an off leak current of a switching element arranged along a data line to control degradation of tonal gradation in an arrangement in which an organic electroluminescent element OLED is driven using a current programming method, a first switching element is set to be in a non-conductive state and a second switching element is set to be in a conductive state during a normal mode. During a test mode, the first switching element is set to be in a conductive state while the second switching element is set to be in a non-conductive state.

12 Claims, 6 Drawing Sheets

ELECTRO-OPTICAL DEVICE, METHOD TO DRIVE THE SAME, AND ELECTRONIC APPARATUS

BACKGROUND OF THE INVENTION

1. Field of Invention

The present invention relates to an electro-optical device, a method to drive the electro-optical device, and an electronic apparatus and, in particular, to a leak prevention remedy to reduce or prevent a leakage of a current-based data signal supplied to a data line.

2. Description of Related Art

Displays using organic EL (Electronic Luminescence) element are popular. The organic EL element is a typical current-driven type element that is driven by a current flowing therethrough, and emits luminance in response to a current level. As one of related art driving methods of organic EL elements, a current program method to supply data to a data line in the form of a current is disclosed in Japanese Unexamined Patent Application Publication No. 2003-22049 and Japanese Unexamined Patent Application Publication No. 2003-22050. The current program method has the advantage that variations in TFT (Thin Film Transistor) characteristics are compensated for to some extent while being subject to insufficient data writing in image displaying at a low tonal gradation level where a data current becomes small.

Japanese Unexamined Patent Application Publication No. 2002-175045 discloses a circuit arrangement in which a switching element is connected to the end of each data line. Specifically, Japanese Unexamined Patent Application Publication No. 2002-175045 discloses a double decoder structure in which an auxiliary data line driving circuit is added at a position opposed from a standard data line driving circuit. The auxiliary data line driving circuit includes a decoder and a plurality of switching elements. One end of the switching element is connected to a data line corresponding to an organic EL element for green (G). The other end of the switching element is connected to a power source line biased with a character displaying voltage. The auxiliary data line driving circuit is used to display characters while serving as a test circuit to detect an open circuit and a pre-charge circuit.

SUMMARY OF THE INVENTION

The drawback of the current program method is that a tonal gradation feature is degraded if an off-leak current (leakage current in a non-conductive state) occurs in a switching element arranged along a data line during a data write operation for a pixel. The reason is that if a leakage current flows through the switching element in the non-conductive state thereof, a current actually supplied to the pixel is a value that is obtained by subtracting the leakage current from an original data current, and therefore luminance of the organic EL element is lowered by an amount corresponding to the leakage current. Such a degradation of the tonal gradation is particularly pronounced at low tonal gradation level, i.e., at a small data current.

In view of the above drawback, the present invention has been developed. The present invention suppresses an off-leak current of a switching element arranged along a data line, and controls degradation of the tonal gradation.

To achieve the above, a first aspect of the invention provides an electro-optical device having an electro-optical element with a current-based data signal therefor, defining a tonal gradation level of pixels, and supplied to data lines, and with the luminance thereof set in response to a driving current flowing from a power source voltage to a voltage lower in level than the power source voltage. The electro-optical device includes the data lines arranged for respective pixels, power source lines to supply the pixels with the power source voltage, signal transfer lines, a first switching element to control electrical conduction between the data line and the signal transfer line, and a second switching element to control electrical conduction between the power source voltage and the signal transfer line. During a first mode in which the data signal is supplied to the data line through the first switching element, the first switching element is set to be in a non-conductive state while the second switching element is set to be in a conductive state. During a second mode in which a signal, different from the data signal, is supplied to the data line through the first switching element, the first switching element is set to be in a conductive state while the second switching element is set to be in a non-conductive state.

In accordance with the first aspect of the invention, the electro-optical device may include a first transistor that writes data to a capacitor in response to the data signal flowing through the channel thereof, and a second transistor that is arranged along the signal transfer line between the first switching element and the second switching element, has the same characteristics as the first transistor, and is configured in a diode-mode connection.

A second aspect of the invention provides an electro-optical device having an electro-optical element with a current-based data signal therefor, defining a tonal gradation level of pixels, and supplied to data lines, and with the luminance thereof set in response to a driving current. The electro-optical device includes the data lines arranged for respective pixels, a signal transfer lines, and a switching element to control electrical conduction between the data line and the signal transfer line. During a first mode in which the data signal is supplied to the data line not through the switching element, the switching element is set to be in a non-conductive state while the signal transfer line is supplied with a predetermined voltage corresponding to a voltage that occurs in the data line when the data line is supplied with the data signal defining the lowest tonal gradation level. During a second mode in which a signal different from the data signal is supplied to the data line through the switching element, the switching element is set to be in a conductive state while the supplying of the predetermined voltage to the signal transfer line is stopped.

In accordance with one of the first and second aspects of the invention, the first mode may be a normal mode to cause the electro-optical device to display an image under normal operating conditions. The second mode may be a test mode to test the electro-optical device. The signal transfer line may be a test line connected to a pad to which an external signal is supplied during the test mode.

In accordance with one of the first and second aspects of the inventions, the power source lines include three lines respectively arranged for the three RGB colors, and the three RGB color power source lines have independent and respective signal transfer lines and switching elements (the first switching element and the second switching element).

A third aspect of the invention provides an electronic apparatus incorporating an electro-optical device according to one of the first and second aspects of the invention.

A fourth aspect of the invention provides a method to drive an electro-optical device having an electro-optical element with a current-based data signal therefor, defining a tonal gradation level of pixels, and supplied to data lines, and with the luminance thereof set in response to a driving current flowing from a power source voltage to a voltage lower in level than the power source voltage. The driving method includes setting, to be in a non-conductive state, a first switching element that controls electrical conduction between the data line arranged for respective pixels and a signal transfer line and for setting, to a conductive state, a second switching element that controls electrical conduction between the power source voltage and the signal transfer line, during a first mode in which the data signal is supplied to the data line not through the first switching element, and setting the first switching element to be in a conductive state and setting the second switching element to be in a non-conductive state, during a second mode in which a signal different from the data signal is supplied to the data line through the first switching element.

In accordance with the fourth aspect of the invention, the electro-optical device further includes a first transistor that writes data to a capacitor in response to the data signal flowing through the channel thereof, and a second transistor that is arranged along the signal transfer line between the first switching element and the second switching element, has the same characteristics as the first transistor, and is configured in a diode-mode connection. The driving method may include a supplying the power source voltage of the power source line to the signal transfer line through the second transistor.

A fifth aspect of the invention provides a method to drive an electro-optical device having an electro-optical element with a current-based data signal therefor, defining a tonal gradation level of pixels, and supplied to data lines, and with the luminance thereof set in response to a driving current. The driving method includes setting, to be in a non-conductive state, a switching element that controls electrical conduction between the data line and the signal transfer line and to supply a signal transfer line with a predetermined voltage corresponding to a voltage that occurs in the data line when the data line is supplied with the data signal defining the lowest tonal gradation level, during a first mode in which the data signal is supplied to the data line arranged for respective pixels, not through the switching element, and setting the switching element to be a conductive state and to stop supplying the predetermined voltage to the signal transfer line, during a second mode in which a signal different from the data signal is supplied to the data line through the switching element.

In accordance with one of the fourth and fifth aspects of the invention, the first mode may be a normal mode to cause the electro-optical device to display an image under normal operating conditions. The second mode may be a test mode to test the electro-optical device. The signal transfer line may be a test line connected to a pad to which an external signal is supplied during the test mode.

DETAILED DESCRIPTION OF EXEMPLARY EMBODIMENTS

First Exemplary Embodiment

Figure 1:
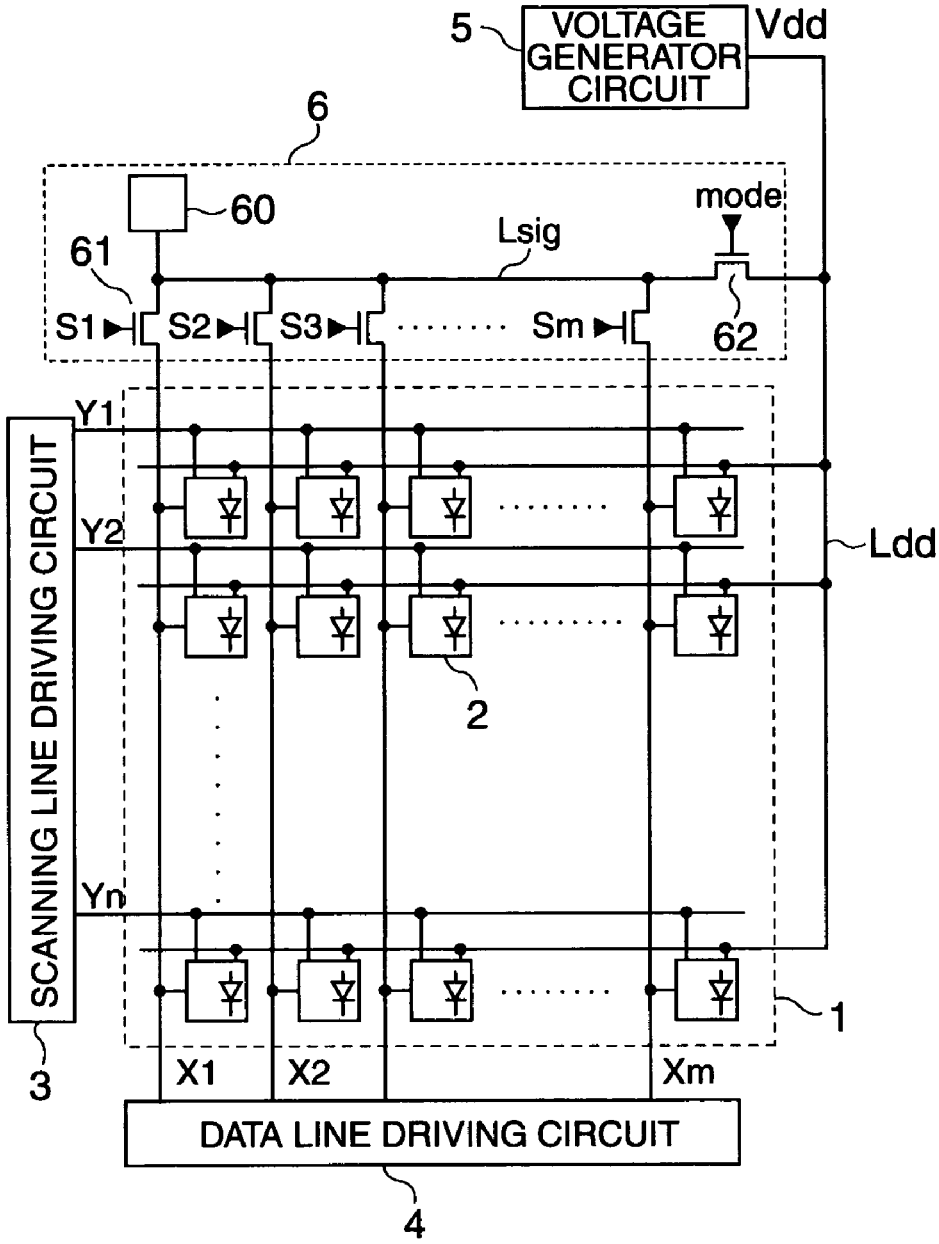
FIG. 1 is a schematic of an electro-optical device in accordance with a first exemplary embodiment of the present invention.

FIG. 1 is a block schematic of an electro-optical device of a first exemplary embodiment of the present invention. Arranged on a display 1 are a matrix of pixels 2 of n rows by m columns (in a two-dimensional plane), a group of scanning lines Y1-Yn extending in a horizontal direction, and a group of data lines X1-Xm extending in a vertical direction. The pixels 2 are arranged at intersections of the group of scanning lines Y1-Yn and the group of data lines X1-Xm. Power source lines Ldd are supplied with a power source voltage Vdd generated in a voltage generator circuit 5. Each pixel 2 is powered through the power source line Ldd. FIG. 1 does not show a power source line to supply each pixel 2 with a reference voltage Vss lower in level than the power source voltage Vdd, and a driving signal line to supply the pixels with a driving signal GP, to be discussed later, on a row by row basis.

Figure 2:
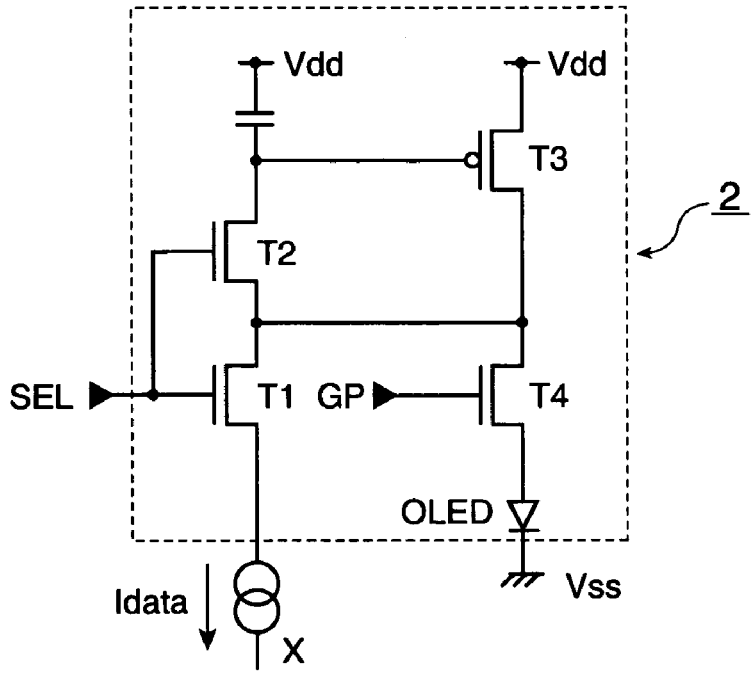
FIG. 2 is a circuit schematic of one example of pixel.

FIG. 2 is a circuit schematic of one example of pixel 2. A single pixel 2 includes an organic electro-luminescent element OLED, four transistors T1-T4, and a capacitor C holding data. The organic electro-luminescent element OLED represented using the symbol of a diode is a typical current driven type element, the emission luminance of which is controlled by a driving current Ioled flowing therethrough. A pixel circuit of the first exemplary embodiment employs the n-channel transistors T1, T2, and T4 and the p-channel transistor T3, for example. The present invention is not limited to this setup.

The transistor T1 is configured with the gate thereof connected to the scanning line Y supplied with a scanning signal SEL, and with the source thereof connected to the data line X supplied with a data current Idata. The drain of the transistor T1 is connected to the source of the transistor T2, the drain of the transistor T3, and the drain of the control transistor T4 as one example of control element. Like the gate of the transistor T1, the gate of the transistor T2 is connected to the scanning line Y supplied with the scanning signal SEL. The drain of the transistor T2 is connected to one electrode of the capacitor C and the gate of the transistor T3. A power source voltage Vdd is fed to the other electrode of the capacitor C and the source of the transistor T3 through a power source line Ldd. The transistor T4 with the gate thereof supplied with a driving signal GP is connected between the drain of the transistor T3 and the anode of the organic electro-luminescent element OLED. The cathode of the organic electro-luminescent element OLED is supplied with a reference voltage Vss.

Figure 3:
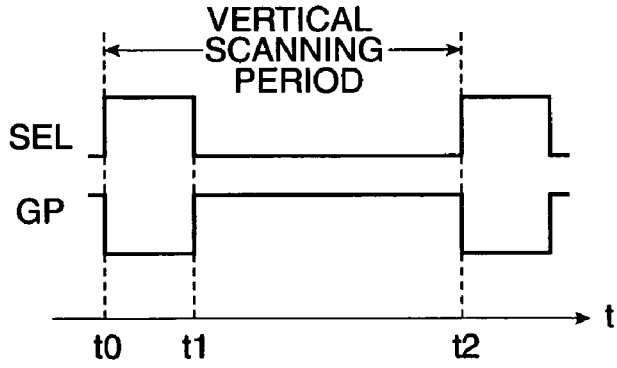
FIG. 3 is a driving timing chart of the example of pixel.

FIG. 3 is a driving timing schematic of the pixel 2 of FIG. 2. Let t0 represent a timing at which a selection of the pixel 2 starts, and let t2 represent a timing at which a next selection of the pixel 2 starts. The period from t0 to t2 is divided into a programming period t0-t1 and a succeeding driving period t1-t2.

During the programming period t0-t1, data is written to the capacitor C. At the timing t0, the scanning signal SEL transitions to a high level, thereby causing the transistors T1 and T2 to be turned on (to be conductive). The transistors T1 and T2 function as switching elements. In response, the data line X is electrically connected to the drain of the transistor T3 while the transistor T3 is shifted into a diode-mode connection with the gate thereof electrically connected to the drain thereof at the same time. The transistor T3 allows the data current Idata supplied through the data line X to flow through the channel thereof, thereby causing a gate voltage Vg responsive to the data current Idata to be generated.

The capacitor C connected to the gate of the transistor T3 stores a charge responsive to the generated gate voltage Vg. Data corresponding to the stored charge is thus written onto the capacitor C. During the programming period t0-t1, the transistor T3 functions as a programming transistor that writes the data to the capacitor C in response to the data signal flowing through the channel thereof. Since the driving signal GP remains at a low level during the period t0-t1, the transistor T4 remains turned off (a non-conductive state). The organic electro-luminescent element OLED does not emit light because a current path of the driving current Ioled to the organic electro-luminescent element OLED is opened.

During the subsequent driving period t1-t2, the driving current Ioled flows through the organic electro-luminescent element OLED, thereby causing the organic electro-luminescent element OLED to emit light. At the timing t1, the scanning signal SEL transitions to a low level, thereby causing the transistors T1 and T2 to be non-conductive. The data line X supplied with the data current Idata is thus electrically isolated from the drain of the transistor T3. The gate and the drain of the transistor T3 are also electrically isolated from each other. The gate of the transistor T3 is continuously supplied with the gate voltage Vg responsive to the charge stored in the capacitor C. The driving signal GP, which has remained at a low level, transitions to a high level in synchronization with the high-to-low transition of the scanning signal SEL at the timing t1. A current path results to cause the driving current Ioled to flow from the power source voltage Vdd to the reference voltage Vss through the transistors T3 and T4 and the organic electro-luminescent element OLED. The driving current Ioled flowing through the organic electro-luminescent element OLED corresponds to a channel current of the transistor T3. The level of the current driving current Ioled is controlled by the gate voltage Vg resulting from the charge stored in the capacitor C. During the driving period t1-t2, the transistor T3 functions as a driving transistor to drive the organic electro-luminescent element OLED. The luminance of the organic electro-luminescent element OLED is set in response to the driving current Ioled.

Under the control of an unshown control circuit, a scanning line driving circuit 3 and a data line driving circuit 4 cooperate with each other, thereby controlling a display 1. The scanning line driving circuit 3 includes, as major elements thereof, shift registers, output circuits, and the like, and outputs the scanning signal SEL (and the driving signal GP) to the scanning lines Y1-Yn, thereby successively selecting the scanning lines Y1-Yn. In such a line-by-line scanning, rows of pixels corresponding to a group of pixels at one horizontal line are successively selected in a predetermined scanning direction (typically from top to bottom) in one vertical scanning period (1 F).

The data line driving circuit 4 arranged at other ends of the data lines X1-Xm includes, as major elements thereof, shift registers, line latch circuits, output circuits, and the like. Since the current program method is adopted, the data line driving circuit 4 includes a variable current source that converts data corresponding to the tonal gradation level of the pixel 2 (the data voltage Vdata) into the data current Idata. During one horizontal scanning period (1 H), the data line driving circuit 4 outputs the data current Idata at a time to a row of pixels that undergoes a write operation while, at the same time, latching, on a pixel-by-pixel basis, data for a row of pixels that is expected to undergo a write operation during a next period 1 H. During a given horizontal scanning period 1 H period, m pieces of data corresponding to the number of data lines X are successively latched. During a next 1 H period, the m pieces of latched data are converted into the data current Idata, which is then output to the data lines X1-Xm all at a time.

A test circuit 6 is provided on the other ends of the data lines X1-Xm. The test circuit 6 is used to perform examinations, including an examination of an open circuit of the data lines X1-Xm and an emission test of the pixel 2. The test circuit 6 includes a pad 60, a plurality of first switching elements 61, a second switching element 62, and a signal transfer line Lsig. The data lines X1-Xm are connected commonly to the signal transfer line Lsig through the first switching elements 61, each of which is arranged for one data line. The signal transfer line Lsig is connected to the pad 60 to which an external signal for testing is supplied, while being connected to the power source line Ldd through the second switching element 62. The conduction of first switching element 61 is controlled by any of control signals S1-Sm that are supplied on a data line by data line basis. The data line X corresponding to the first switching element 61 in the conductive state thereof is connected(conducted) to the signal transfer line Lsig. The conduction of the second switching element 62 is controlled by a mode signal Mode. The second switching element 62 in the conductive state thereof connects (conducts) the power source line Ldd (at the power source voltage Vdd) to the signal transfer line Lsig.

In the first exemplary embodiment of the present invention, n-channel transistors are used as the first switching elements 61 and 62. Alternatively, p-channel transistors may be used.

Two modes, specifically, a normal mode and a test mode are available as operation modes of the electro-optical device. The normal mode is set to cause the electro-optical device to display an image under normal operating conditions, and the test mode is set to test the electro-optical device.

To set the electro-optical device to the normal mode, the mode signal Mode is set to be high in level while all control signals S1-Sm are set to be low in level. The second switching element 62, with the conduction thereof controlled by the mode signal Mode, is turned on, thereby electrically connecting the signal transfer line Lsig to the power source line Ldd. The first switching elements 61 are turned off, electrically isolating the signal transfer line Lsig from the data lines X1-Xm. The data signal is supplied to the data line X from the data line driving circuit 4 not through the first switching element 61 rather than from the signal transfer line Lsig through the first switching element 61 during the normal mode. The data current Idata is supplied to the data line X from the data line driving circuit 4, and writes the data onto the pixels 2 in cooperation with the scanning line driving circuit 3. The voltage of the signal transfer line Lsig not contributing to signal supplying, specifically, the voltage of one terminal of the first switching element 61 (the terminal opposite from the terminal connected to the data line X) is fixed to a voltage approximately equal to the power source voltage Vdd supplied from the power source line Ldd.

During the test mode, the mode signal Mode is set to be low in level while any or all of the control signals S1-Sm are set to be high in level depending on an item to be tested. The second switching element 62 with the conduction thereof controlled by the mode signal Mode is turned off, thereby electrically isolating the signal transfer line Lsig from the power source line Ldd. At the same time, the first switching element 61 is turned on as necessary, thereby electrically connecting the signal transfer line Lsig to the data line X corresponding to the first switching element 61 that is currently conductive. During the test mode, a signal (different from the data signal) is supplied to the data line X through the first switching element 61 from the signal transfer line Lsig rather than from the data line driving circuit 4. Specifically, with the signal transfer line Lsig isolated from the power source line Ldd, an external signal supplied from the pad 60 is fed to the data line X from the corresponding first switching element 61 and the signal transfer line Lsig.

Figure 4:
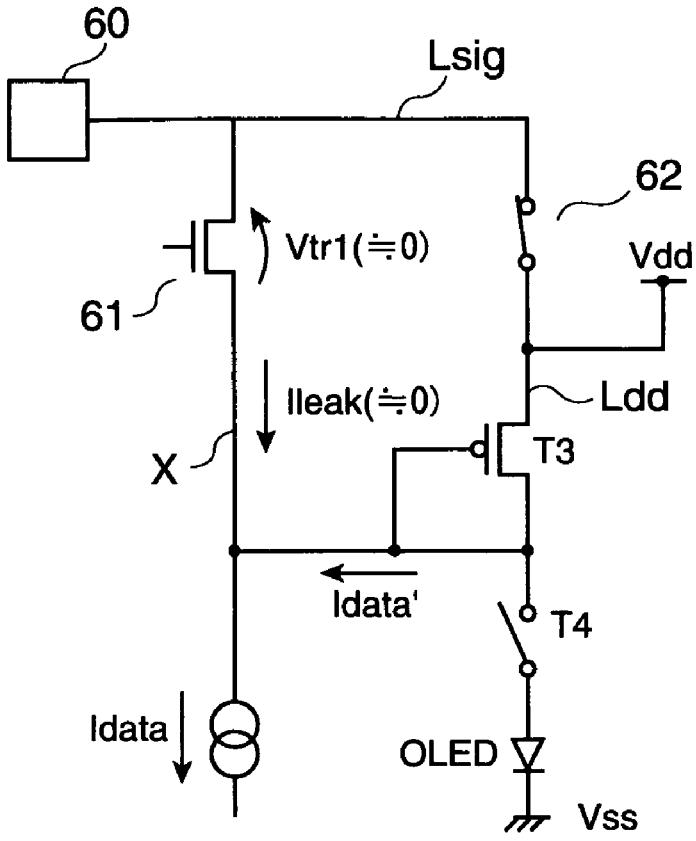
FIG. 4 illustrates a data write operation to write data to the pixel in accordance with the first exemplary embodiment of the present invention.

In accordance with the first exemplary embodiment of the present invention, the off-leak of the first switching element 61 forming part of the test circuit 6 is controlled to enhance display quality. FIG. 4 illustrates a data write operation to the pixel 2 during the above-referenced programming period t0-t1.

The transistors T1 and T2 in the conductive state thereof are omitted in FIG. 4.

When the data line driving circuit 4 supplies the data current Idata to the data line X, a data Idata' actually supplied to each pixel 2 is the difference between the data current Idata and a leakage current Ileak (Idata-Ileak). The leakage current Ileak is the current flowing through the first switching element 61 in the non-conductive state thereof. The larger the leakage current Ileak, the more the actual display tonal gradation level deviates from the original tonal gradation level (and the emission luminance of the organic electro-luminescent element OLED drops more). The tonal gradation deviation becomes pronounced at a low tonal gradation level where insufficient data writing tends to occur, and leads to a drop in contrast. Ideally, if the leakage current Ileak is set to be zero at the low tonal gradation level, such a tonal gradation degradation is avoided. The leakage current Ileak increases more as the off resistance of the first switching element 61 becomes smaller. The off resistance depends on a potential difference Vtr1 in the channel (between the source and the drain) of the first switching element 61. If the potential difference Vtr1 becomes zero, the leakage current Ileak also becomes zero.

In view of this drawback, the first exemplary embodiment of the present invention sets the voltage at the signal transfer line Lsig so that the potential difference of the first switching element 61 Vtr1 becomes zero at the lowest tonal gradation level during the data writing operation. At the lowest tonal gradation level, the data current Idata becomes zero or almost zero, the voltage of the one terminal of the first switching element 61 (specifically, the voltage of the data line X) becomes a voltage close to the power source voltage Vdd (but not the same voltage as the power source voltage Vdd). Since the second switching element 62 is turned on during the normal mode, the voltage at the other terminal of the first switching element 61 (specifically, the voltage at the signal transfer line Lsig) also becomes close to the power source voltage Vdd. Since the potential difference Vtr1 of the first switching element 61 becomes almost zero, the leakage current Ileak also becomes almost zero. The data current Idata' almost equal to the data current Idata is fed to the pixel 2. As a result, the tonal gradation deviation is alleviated at the low tonal gradation level, and display quality is enhanced.

Second Exemplary Embodiment

Figure 5:
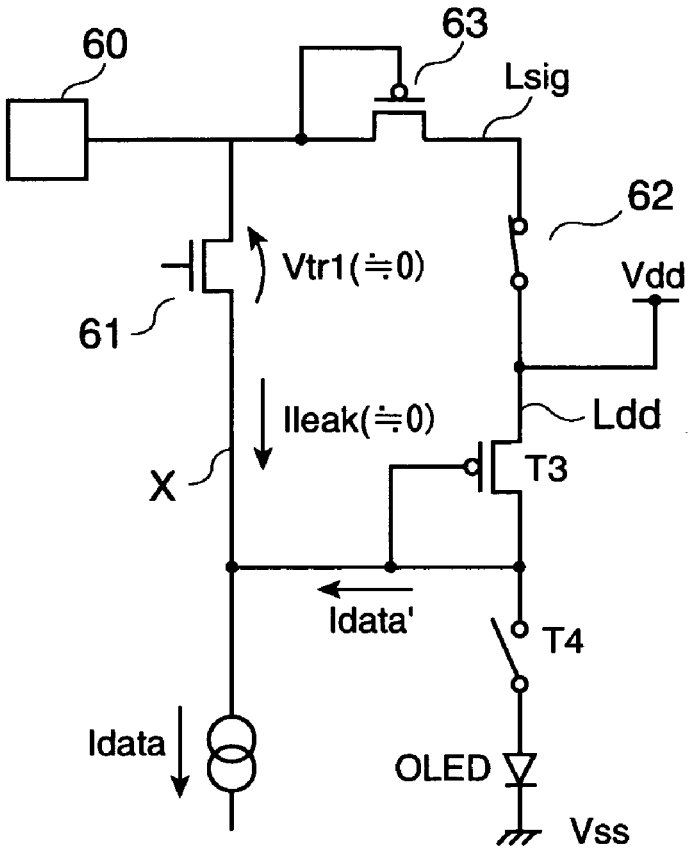
FIG. 5 illustrates a data write operation to write data to the pixel in accordance with a second exemplary embodiment of the present invention.

FIG. 5 is a circuit schematic illustrating the data write operation for writing data to the pixel 2 in accordance with a second exemplary embodiment of the present invention. In FIG. 5, circuit elements already discussed with reference to FIG. 4 are designated with the same reference numerals, and the discussion thereof is omitted here. The feature of the second exemplary embodiment is that a transistor 63 configured in a diode-mode connection is added in the test circuit 6. The transistor 63 is arranged along the signal transfer line Lsig between the first switching element 61 and the second switching element 62, and has the same characteristics as those of the transistor T3 functioning as a programming transistor. As the data line X is supplied with a voltage lower than the power source voltage Vdd by a threshold voltage Vth of the transistor T3, the signal transfer line Lsig is supplied with a voltage lower than the power source voltage Vdd by a threshold voltage Vth of the transistor 63. In comparison with the first exemplary embodiment, the potential difference Vtr1 of the first switching element 61 is closer to zero. The leakage current Ileak is more effectively controlled. As a result, the tonal gradation deviation at the low tonal gradation level is alleviated more, and display quality is thus enhanced.

Third Exemplary Embodiment

Figure 6:
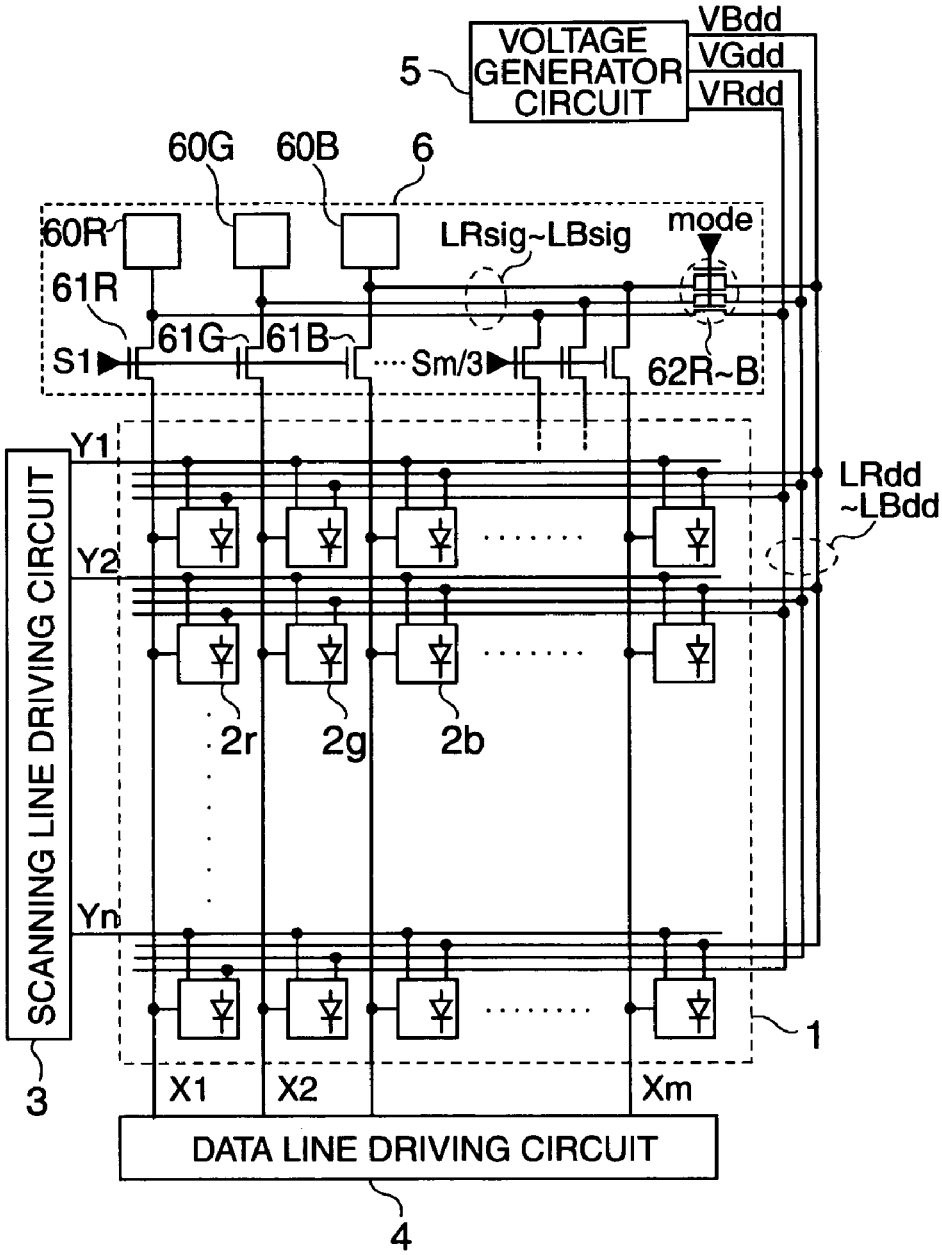
FIG. 6 is a schematic illustrating an electro-optical device in accordance with a third exemplary embodiment of the present invention.

In accordance with a third exemplary embodiment, voltages of the signal transfer lines Lsig are independently set for R (red), G (green), and B (blue). FIG. 6 is a schematic illustrating an electro-optical device of the third exemplary embodiment of the present invention. One pixel, which is a minimum element of an image, is composed of an R pixel 2*r* connected to a power source line LRdd for the R, a G pixel 2*g* connected to a power source line LGdd for the G, and a B pixel 2*b* connected to a power source line LBdd for the B. The three lines of the power source line LRdd, the power source line LGdd and the power source line LBdd are arranged to set the power source voltages Vdd for respective RGB colors taking into consideration that the organic electro-luminescent elements OLED are different in optical characteristics from R to G to B. The voltage generator circuit 5 generates separately a driving voltage VRdd for the R, a driving voltage VGdd for the G, and a driving voltage VBdd for the B, and supplies the driving voltage VRdd, the driving voltage VGdd and the driving voltage VBdd to the power source line LRdd, the power source line LGdd and the power source line LBdd, respectively.

The test circuit 6 includes an R test unit composed of circuit elements 60R, 61R, and 62R, a G test unit composed of circuit elements 60G, 61G, and 62G, and a B test unit composed of circuit elements 60B, 61B, and 62B. The structure of the test unit remains unchanged from that of the first exemplary embodiment, and the discussion thereof is omitted here. The transistor 63, which has been discussed in connection with the second exemplary embodiment, may be added to each test unit.

In accordance with the third exemplary embodiment, the test circuit 6 includes three mutually independent RGB test units which correspond RGB. Even if the power source voltages Vdd different from R to G to B, the potential difference Vtr1 at the low tonal gradation level is set to be almost zero. Like in the first and second exemplary embodiments, the leakage current Ileak is reduced. An enhanced quality display is thus achieved.

The present invention is not limited to the circuit arrangement illustrated in FIG. 2. The present invention is applicable to a variety of circuit arrangements including one to be discussed below.

Figure 7:
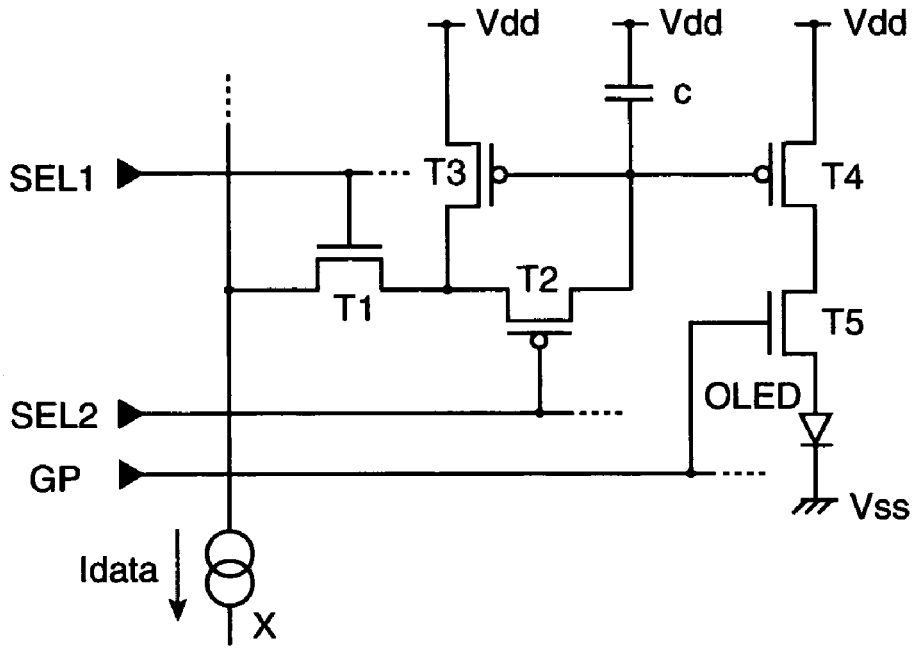
FIG. 7 is a circuit schematic illustrating another example of pixel.

FIG. 7 illustrates a circuit schematic of another example of the pixel 2. The single pixel 2 includes an organic electro-luminescent element OLED, five transistors T1-T5 as active elements, and a capacitor C holding data. In this pixel circuit, the transistors T1 and T5 are of an n-channel type, while the transistors T2-T4 are a p-channel type. This setup is an example only, and the present invention is not limited to this setup.

The transistor T1 is configured with the gate thereof connected to a scanning line supplied with a first scanning signal SEL1, and with the source thereof connected to a data line X supplied with a data current Idata. The drain of the transistor T1 is connected to the drain of the transistor T2, and the drain of the transistor T3 functioning as a programming transistor. The source of the transistor T2, with the gate thereof receiving a second scanning signal SEL2, is connected commonly to the gates of a pair of transistors T3 and T4, forming a current mirror circuit, and one electrode of the capacitor C. A power source voltage Vdd is supplied to the source of the transistor T3, the source of the transistor T4, and the other electrode of the capacitor C. The transistor T5 with the gate thereof supplied with a driving signal GP is arranged along a current path of the driving current Ioled between the drain of the transistor T4 and the anode of the organic electro-luminescent element OLED. The cathode of the organic electro-luminescent element OLED is supplied with a reference voltage Vss. The transistors T3 and T4 with the gates thereof connected together form the current mirror circuit. The current level of the data current Idata flowing through the channel of the transistor T3 functioning as the programming transistor is proportional to the current level of the driving current Ioled flowing through the transistor T4 functioning as a driving transistor.

Figure 8:
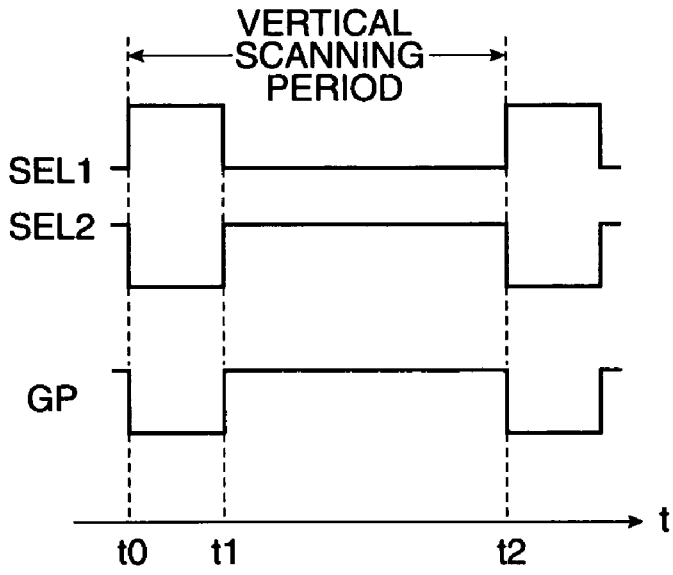
FIG. 8 is a driving timing chart of another example of pixel.

FIG. 8 is a driving timing schematic of the pixel 2 of FIG. 7. Let t0 represent a timing at which a selection of the pixel 2 starts in a line-by-line scanning operation of the scanning line driving circuit 3, and let t2 represent a timing at which a next selection of the pixel 2 starts. The period from t0 to t2 is divided into a programming period t0-t1 and a succeeding driving period t1-t2.

During the programming period t0-t1, data is written to the capacitor C in response to the selection of the pixel 2. At the timing t0, the first scanning signal SEL1 transitions to a high level, thereby causing the transistor T1 to be turned on. In response, the data line X is electrically connected to the drain of the transistor T3. In synchronization with the low-to-high transition of the first scanning signal SEL1, the second scanning signal SEL2 transitions to a low level, thereby causing the transistor T2 to be turned on. The transistor T3 is shifted into a diode-mode connection with the gate thereof electrically connected to the drain thereof at the same time, thereby functioning as a non-linear resistor element. The transistor T3 allows the data current Idata supplied through the data line X to flow through the channel thereof, thereby causing, at the gate thereof, a gate voltage Vg responsive to the data current Idata. The capacitor C connected to the gate of the transistor T3 stores a charge responsive to the generated gate voltage Vg, thereby writing data thereon.

During the subsequent driving period t1-t2, the driving current Ioled responsive to the charge stored in the capacitor C flows through the organic electro-luminescent element OLED, thereby causing the organic electro-luminescent element OLED to emit light. At the timing t1, the first scanning signal SEL1 transitions to a low level, thereby causing the transistor T1 to be non-conductive. The data line X and the drain of the transistor T3 are electrically isolated from each other, and the supplying of the data current Idata to the transistor T3 is suspended. In synchronization with the high-to-low transition of the first scanning signal SEL1, the second scanning signal SEL2 transitions to a high level, thereby causing the transistor T2 to be non-conductive. The gate and the drain of the transistor T3 are electrically isolated from each other. The gate of the transistor T4 is supplied with a voltage approximately equal to the gate voltage Vg responsive to the charge stored in the capacitor C. The driving signal GP transitions from a low level to a high level. A current path results to cause the driving current Ioled to flow from the power source voltage Vdd to the reference voltage Vss through the transistors T4 and T5 and the organic electro-luminescent element OLED. The driving current Ioled flowing through the organic electro-luminescent element OLED corresponds to a channel current of the transistor T4. The level of the current driving current Ioled is controlled by the gate voltage Vg resulting from the charge stored in the capacitor C. As a result, the organic electro-luminescent element OLED emits light at luminance responsive to the driving current Ioled.

In each of the above exemplary embodiments, the first switching element 61 is arranged along the data line X as a part of the test circuit 6. The present invention is not limited to the switching element in the test circuit 6. The present invention is equally applicable to a switching element used in other applications. For example, the present invention is applicable to a structure in which a switching element for precharge is arranged along a data line, or a double decoder structure disclosed in Japanese Unexampled Patent Application Publication No. 2002-175045.

In each of the above-referenced exemplary embodiments, the organic electro-luminescent element OLED is used as an electro-optical element. The present invention is not limited to the organic electro-luminescent element OLED. The present invention is applicable to an electro-optical element that sets luminance in response to a driving current.

Each of the electro-optical devices of the above-referenced exemplary embodiments may be applied to a variety of electronic apparatuses including a projector, a cellular phone, a mobile terminal, a mobile computer, etc. With the above-referenced electro-optical device incorporated in the electronic apparatus, the electronic apparatus appeals to consumers in the market with a higher commercial value.

Advantages

In accordance with an aspect of the present invention, a switching element is set to be non-conductive in a first mode in which a data signal is supplied to a data line not through a switching element. When the data signal defining the lowest toner degradation level is fed to the data line, a predetermined voltage approximately equal to a voltage that occurs in the data line is applied to a signal transfer line. A leakage current in the switching element in the non-conductive state thereof is reduced, and degradation of tonal gradation is thus controlled.

What is claimed is:

1. An electro-optical device, comprising:

an electro-optical element with a current-based data signal defining a tonal gradation level of pixels, and supplied to data lines, and with a luminance set in response to a driving current flowing from a power source voltage to a voltage lower in level than the power source voltage;

the data lines arranged for respective pixels;

power source lines to supply the pixels with the power source voltage;

signal transfer lines;

a first switching element to control electrical conduction between the data line and the signal transfer line; and a second switching element to control electrical conduction between the power source voltage and the signal transfer line, during a first mode in which the data signal is supplied to the data line not through the first switching element, the first switching element is set to be in a non-conductive state while the second switching element is set to be in a conductive state, and during a second mode in which a signal different from the data signal is supplied to the data line through the first switching element, the first switching element is set to be in a conductive state while the second switching element is set to be in a non-conductive state.

2. The electro-optical device according to claim 1, further comprising:

a first transistor that writes data to a capacitor in response to the data signal flowing through a data signal channel; and a second transistor arranged along the signal transfer line between the first switching element and the second switching element, having the same characteristics as the first transistor, and is configured in a diode-mode connection.

3. An electro-optical device, comprising:

an electro-optical element with a current-based data signal defining a tonal gradation level of pixels, supplied to data lines and with a luminance set in response to a driving current;

the data lines arranged for respective pixels;

signal transfer lines; and a switching element to control electrical conduction between the data line and the signal transfer line, during a first mode in which the data signal is supplied to the data line not through the switching element, the switching element is set to be in a non-conductive state while the signal transfer line is supplied with a predetermined voltage corresponding to a voltage that occurs in the data line when the data line is supplied with the data signal defining the lowest tonal gradation level, and during a second mode in which a signal different from the data signal is supplied to the data line through the switching element, the switching element is set to be in a conductive state while the supplying of the predetermined voltage to the signal transfer line is stopped.

4. The electro-optical device according to claim 1, the first mode being a normal mode to cause the electro-optical device to display an image under normal operating conditions, and the second mode being a test mode to test the electro-optical device.

5. The electro-optical device according to claim 4, the signal transfer line is a test line connected to a pad to which an external signal is supplied during the test mode.

6. The electro-optical device according to claim 1, the power source lines including three lines respectively arranged for the three RGB colors, and the three RGB color power source lines have independent and respective signal transfer lines and switching elements.

7. An electronic apparatus incorporating the electro-optical device according to claim 1.

8. A method to drive an electro-optical device having an electro-optical element with a current-based data signal defining a tonal gradation level of pixels, and supplied to data lines, and with a luminance set in response to a driving current flowing from a power source voltage to a voltage lower in level than the power source voltage, the method comprising:

setting, to be in a non-conductive state, a first switching element that controls electrical conduction between the data line arranged for respective pixels and a signal transfer line and setting, to a conductive state, a second switching element that controls electrical conduction between the power source voltage and the signal transfer line, during a first mode in which the data signal is supplied to the data line not through the first switching element; and setting the first switching element to be in a conductive state and setting the second switching element to be in a non-conductive state during a second mode in which a signal different from the data signal is supplied to the data line through the first switching element.

9. The method to drive an electro-optical device according to claim 8, the electro-optical device including a first transistor that writes data to a capacitor in response to the data signal flowing through the channel thereof, and a second transistor that is arranged along the signal transfer line between the first switching element and the second switching element, has the same characteristics as the first transistor, and is configured in a diode-mode connection, the method further comprises:

supplying the power source voltage of the power source line to the signal transfer line through the second transistor.

10. The method to drive an electro-optical device having an electro-optical element with a current-based data signal defining a tonal gradation level of pixels, and supplied to data lines and with a luminance set in response to a driving current, the method comprising:

setting, to be in a non-conductive state, a switching element that controls electrical conduction between the data line and a signal transfer line, and supplying the signal transfer line with a predetermined voltage corresponding to a voltage that occurs in the data line when the data line is supplied with the data signal defining the lowest tonal gradation level, during a first mode in which the data signal is supplied to the data line arranged for respective pixels, not through the switching element; and setting the switching element to be a conductive state and stopping the supplying of the predetermined voltage to the signal transfer line, during a second mode in which a signal different from the data signal is supplied to the data line through the switching element.

11. The method to drive an electro-optical device according to claim 8, the first mode being a normal mode to cause the electro-optical device to display an image under normal operating conditions, and the second mode being a test mode for testing the electro-optical device.

12. The method to drive an electro-optical device according to claim 11, the signal transfer line being a test line connected to a pad to which an external signal is supplied during the test mode.

* * * * *